US008803502B2

(12) United States Patent
Lee

(10) Patent No.: US 8,803,502 B2
(45) Date of Patent: Aug. 12, 2014

(54) VOLTAGE REGULATOR

(75) Inventor: Hyun Chul Lee, Icheon-si (KR)

(73) Assignee: SK Hynix Inc., Gyeonggi-do (KR)

( * ) Notice: Subject to any disclaimer, the term of this patent is extended or adjusted under 35 U.S.C. 154(b) by 35 days.

(21) Appl. No.: 13/600,514

(22) Filed: Aug. 31, 2012

(65) Prior Publication Data

US 2013/0141066 A1 Jun. 6, 2013

(30) Foreign Application Priority Data

Dec. 1, 2011 (KR) ..... 10-2011-0127910

(51) Int. Cl.
*G05F 1/575* (2006.01)
*G05F 1/595* (2006.01)

(52) U.S. Cl.
USPC ..... 323/297; 323/273; 323/354

(58) Field of Classification Search
USPC ..... 323/297, 298, 353, 354, 273
See application file for complete search history.

(56) References Cited

U.S. PATENT DOCUMENTS

| | | | | |
|---|---|---|---|---|
| 7,019,585 | B1 * | 3/2006 | Wilson et al. | 327/541 |
| 7,619,402 | B1 * | 11/2009 | Kwong | 323/369 |
| 7,965,065 | B2 * | 6/2011 | Hirota | 323/233 |
| 2012/0112725 | A1 * | 5/2012 | Li et al. | 323/297 |

FOREIGN PATENT DOCUMENTS

KR 10-2012-0082229 A 7/2012

* cited by examiner

*Primary Examiner* — Gary L Laxton
(74) *Attorney, Agent, or Firm* — William Park & Associates Patent Ltd.

(57) ABSTRACT

A voltage regulator includes a voltage generation unit, a first resistor section, and a second resistor section. The voltage generation unit compares a reference voltage level with a voltage level of a first node and generates an output voltage. The first resistor section includes a first sub-resistor and a second sub-resistor between the first node and a ground voltage node, and controls a connection between the first sub-resistor and the second sub-resistor to change a resistance value of the resistors. The second resistor section includes a reference resistor, a plurality of unit resistors, and a plurality of step resistors, and controls connections of the unit resistors and the step resistors to change a resistance value of the resistors.

16 Claims, 5 Drawing Sheets

VOLTAGE REGULATOR

CROSS-REFERENCES TO RELATED APPLICATION

The present application claims priority under 35 U.S.C. §119(a) to Korean application number 10-2011-0127910 filed on Dec. 1, 2011, in the Korean Intellectual Property Office, which is incorporated herein by reference in its entirety.

BACKGROUND

1. Technical Field

The present invention relates generally to a semiconductor integrated circuit, and more particularly to a voltage regulator.

2. Related Art

A semiconductor memory apparatus has a voltage regulator is in order to generate a voltage used therein. In designing the voltage regulator, it is important to stably provide a voltage of a desired target level.

SUMMARY

In an embodiment of the present invention, a voltage regulator includes: a voltage generation unit configured to compare a reference voltage level with a voltage level of a first node and generate an output voltage at an output terminal thereof; a first resistor section including a first sub-resistor and a second sub-resistor between the first node and a ground voltage, and controlling a connection between the first sub-resistor and the second sub-resistor to change a size of the resistors; and a second resistor section including a reference resistor, a plurality of unit resistors, and a plurality of step resistors obtained by dividing a size of the unit resistors between the output terminal and the first node, and controlling connections of the unit resistors and the step resistors to change a size of the resistors.

In an embodiment of the present invention, a voltage regulator includes: a voltage generation unit configured to compare a reference voltage level with a voltage level of a first node and generate an output voltage at an output terminal thereof; a first resistor section including a first sub-resistor and a second sub-resistor between the first node and a ground voltage, and controlling a connection of the first sub-resistor according to a division signal; and a second resistor section including a reference resistor and a plurality of second resistors between the output terminal and the first node, controlling connections of the plurality of second resistors to change a size of the resistors, and reducing a size of each second resistor to ½ according to the division signal.

In an embodiment of the present invention, a voltage regulator includes: a voltage generation unit configured to compare a reference voltage level with a voltage level of a first node and generate an output voltage at an output terminal thereof; a first sub-resistor and a second sub-resistor serially connected between the first node and a ground voltage; a first transistor having source and drain terminals connected at both ends of the first sub-resistor and a gate terminal for receiving a division signal; a reference resistor, a unit resistor, and a plurality of step resistors serially connected between the output terminal and the first node; a second transistor having source and drain terminals connected at both ends of the unit resistor and a gate terminal for receiving a unit resistor selection signal; and a plurality of third transistors having source terminals, which are connected to a plurality of nodes through which the unit resistor is connected to the plurality of step resistors, drain terminals connected to the first node, and gate terminals for receiving a step resistor selection signal, respectively, wherein the step resistor has a value obtained by dividing a size of the unit resistor by a plural number.

BRIEF DESCRIPTION OF THE DRAWINGS

Features, aspects, and embodiments are described in conjunction with the attached drawings, in which.

DETAILED DESCRIPTION

Hereinafter, a voltage regulator according to the present invention will be described in detail with reference to the accompanying drawings through an exemplary embodiment of the present invention.

Figure 1:
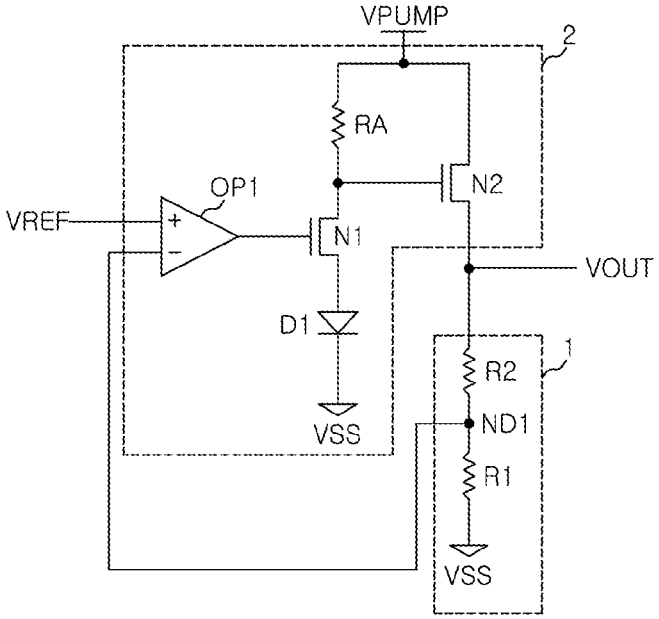
FIG. 1 is a circuit diagram of a voltage regulator according to an embodiment of the present invention.

FIG. 1 is a circuit diagram of a voltage regulator according to an embodiment of the present invention.

The voltage regulator includes a voltage generation unit 2 and a resistor unit 1.

The voltage generation unit 2 compares a reference voltage VREF with a voltage level of a first node ND1, and controls an output voltage VOUT according to a result of the comparison. That is, when the output voltage VOUT changes from a target level, the voltage generation unit 2 adjusts the supply of a pumping voltage VPUMP according to the output of a comparator OP1, thereby stably controlling the output voltage VOUT.

The resistor unit 1 has a function of adjusting a resistance value to adjust the level of the output voltage VOUT. In the voltage regulator, the output voltage VOUT may be expressed by Equation below.

$$VOUT=(1+R2/R1)*VREF$$

Since the voltage regulator is a negative feedback circuit, the level of the output voltage VOUT corresponds to (1+R2/R1) times the reference voltage VREF. This represents that it is possible to generate an output voltage VOUT of another target level by adjusting the ratio of a second resistor R2 with respect to a first resistor R1 in the resistor unit 1.

Figure 2:
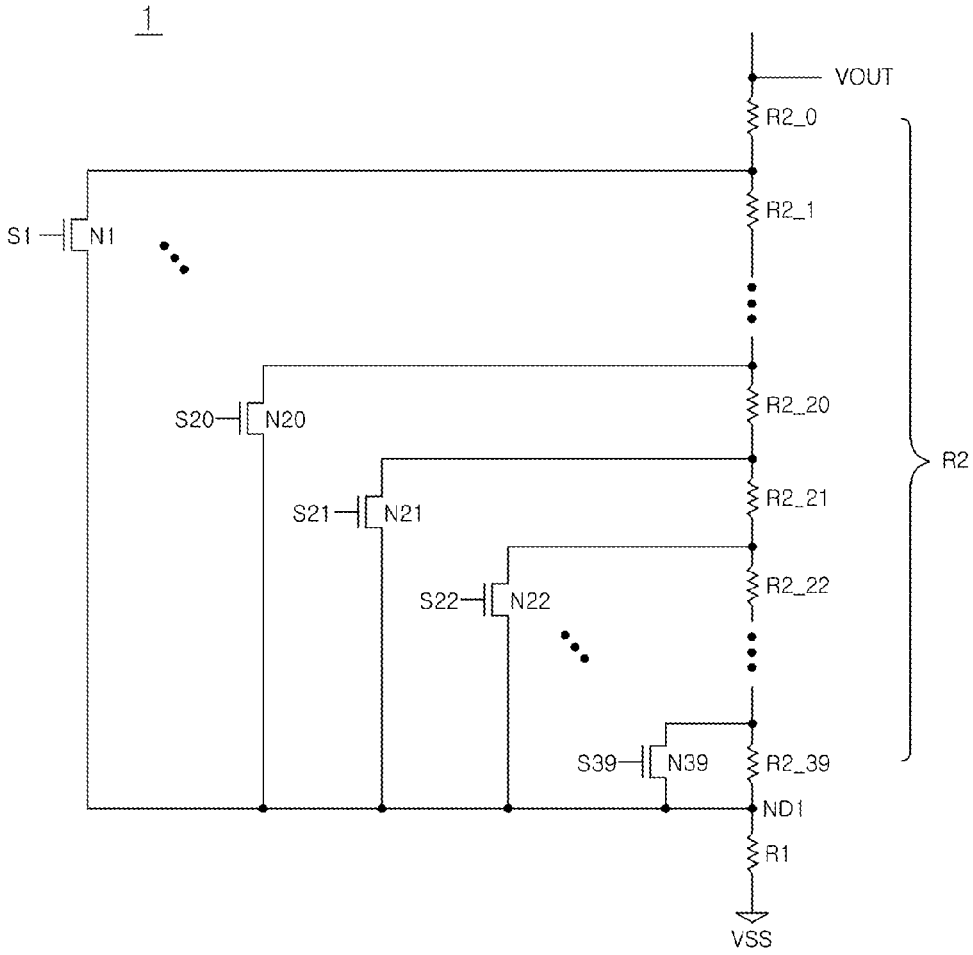
FIG. 2 is a circuit diagram of a resistor unit of FIG. 1 according to an embodiment of the present invention.

FIG. 2 is a circuit diagram of a resistor unit 1 according to an embodiment of the present invention. In a known art, in order to adjust the resistor ratio (R2/R1), the resistance value of the second resistor R2 is changed.

The resistor unit 1 includes a first resistor R1 connected between a first node ND1 and a ground voltage VSS, and a reference resistor R2_0 and a plurality of second resistors R2_1 to R2_39 connected between an output voltage VOUT and the first node ND1. Here, the number of second resistors R2 to be connected is adjusted in response to a plurality of selection signals S1 to S39.

For example, when it is assumed that the resistance value of the reference resistor R2_0 is set to 40Ω and the resistance value of each of the plurality of second resistors R2_1 to R2_39 is set to 1Ω, connections of the second resistors R2_1 to R2_39 are controlled using the selection signals S1 to S39, so that it is possible to adjust the resistance ratio (i.e., R2/R1). Thus, if the first resistor R1 is 10Ω, since an output voltage VOUT, when only the reference resistor R2_0 is connected, has a level of 5*VREF and the level of the output voltage VOUT increases by 0.1*VREF per every additional connection of the second resistor R2, the output voltage VOUT has a maximum level of 8.9*VREF.

However, the method for adjusting the level of the output voltage VOUT in the resistor unit 1 requires many resistors R2_1 to R2_39 and selection transistors N1 to N39 in order to perform fine adjustment, and thus the area of the resistor unit 1 may increase.

Figure 3:
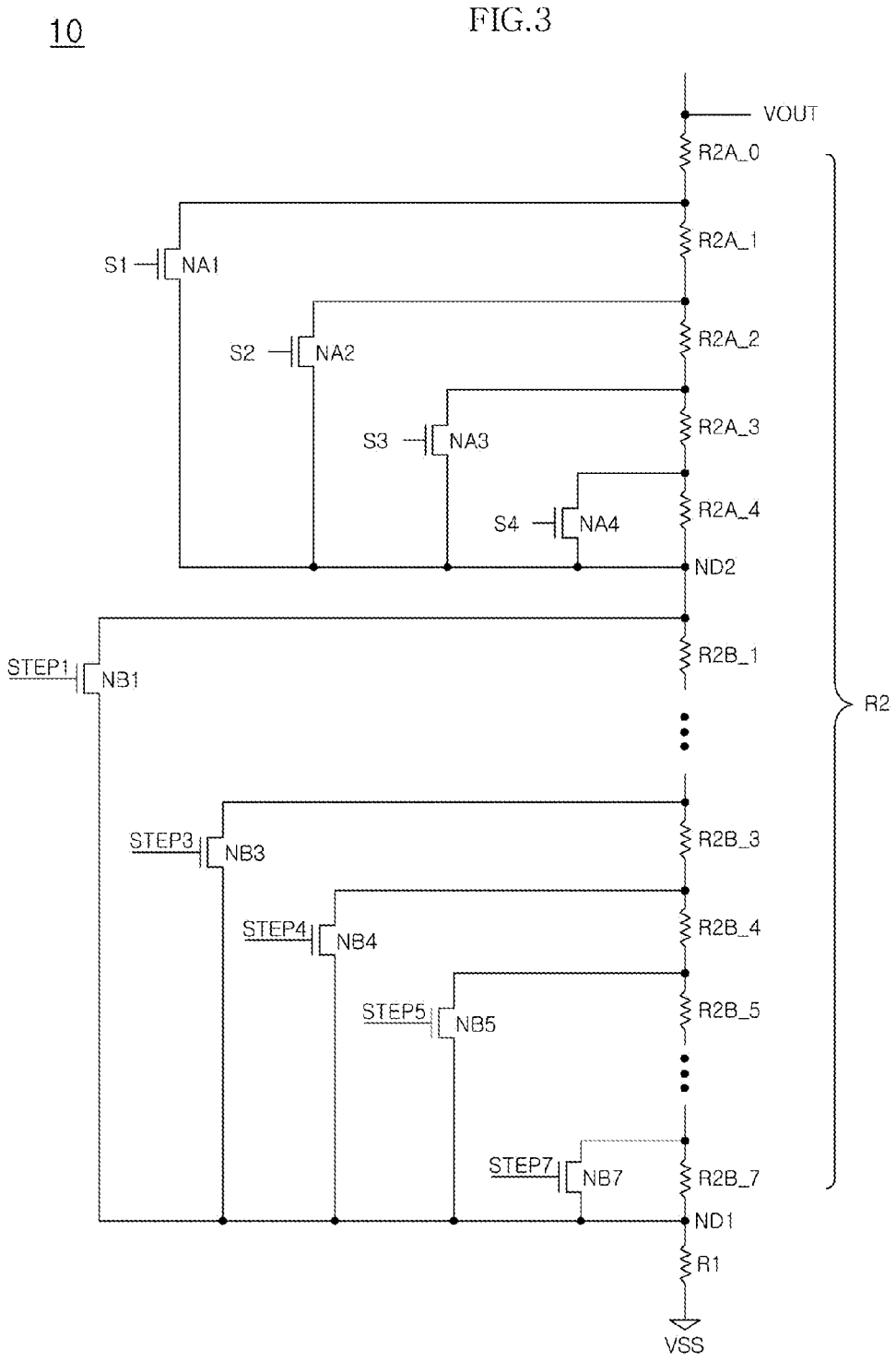
FIG. 3 is a circuit diagram of a resistor unit according to an embodiment of the present invention.

FIG. 3 is a circuit diagram illustrating a resistor unit of a voltage regulator according to an embodiment of the present invention.

According to an embodiment of the present invention, a resistor unit for adjusting the resistor ratio (R2/R1) is configured in the voltage regulator having the feedback structure in which the output voltage VOUT has a voltage level corresponding to (1+R2/R1) times the reference voltage VREF.

A resistor unit 10 of FIG. 3 includes a first resistor section R1 and a second resistor section R2.

The first resistor section R1 is coupled between a first node ND1 and a ground voltage VSS and has a resistance value set to a predetermined level.

The second resistor section R2 includes a reference resistor R2A_0, a plurality of unit resistors R2A_1, R2A_2, . . . , R2A_4, and a plurality of step resistors R2B_1, R2B_2, . . . , R2B_7 serially coupled to one another. Here, the resistance value of each step resistors R2B_1, R2B_2, . . . , R2B_7 may be obtained by dividing the resistance value of each unit resistors R2A_1, R2A_2, . . . , R2A_4. Furthermore, the second resistor section R2 includes a plurality of selection transistors NA1, NA2, . . . , NA4 and NB1, NB2, . . . , NB7 which control connections of the plurality of unit resistors R2A_1, R2A_2, . . . , R2A_4 and connections of the plurality of step resistors R2B_1, R2B_2, . . . , R2B_7, respectively.

The plurality of unit resistors R2A_1, R2A_2, . . . , R2A_4 may be configured for rough adjustment, and the plurality of step resistors R2B_1, R2B_2, . . . , R2B_7 may be configured for fine adjustment.

The connections of the plurality of unit resistors R2A_1, R2A_2, . . . , R2A_4 are controlled using the plurality of unit selection transistors NA1, NA2, . . . , NA4 and a plurality of unit resistor selection signals S1, S2, . . . , S4. The plurality of unit selection transistors NA1, NA2, . . . , NA4 have gate terminals for receiving the corresponding unit resistor selection signals S1, S2, . . . , S4, source terminals coupled to nodes, through which the reference resistor R2A_0 is coupled to the plurality of unit resistors R2A_1, R2A_2, . . . , R2A_4, and drain terminals coupled to a second node ND2, respectively.

The connections of the plurality of step resistors R2B_1, R2B_2, . . . , R2B_7 are controlled using the plurality of step selection transistors NB1, NB2, . . . , NB7 and a plurality of step resistor selection signals STEP1, STEP2, . . . , STEP7. The plurality of step selection transistors NB1, NB2, . . . , NB7 have gate terminals for receiving the corresponding step selection signals STEP1, STEP2, . . . , STEP7, source terminals coupled to a plurality of nodes, through which the second node ND2 and the plurality of step resistors R2B_1, R2B_2, . . . , R2B_7 are coupled to each other, and drain terminals coupled to the first node ND1, respectively.

For example, the reference resistor R2A_0 may be set to 40Ω, each unit resistor R2A_1, R2A_2, . . . , R2A_4 may be set to 8Ω, and each step resistor R2B_1, R2B_2, . . . , R2B_7 may be set to 1Ω. In this case, the connections of the unit resistors R2A_1, R2A_2, . . . , R2A_4 can be controlled so as to adjust the resistance value of the second resistor section R2 by multiples of 8Ω such as 48Ω, 56Ω, or 64Ω, and the connections of the step resistors R2B can be controlled so as to adjust the resistance value of the second resistor section R2 by multiples of 1Ω smaller than the unit resistance of the unit resistors R2A_1, R2A_2, . . . , R2A_4.

As a consequence, the resistance value of the second resistor section R2 can be adjusted from 40Ω to 79Ω at an interval of 1Ω using the reference resistor R2A_0, the four unit resistors R2A_1, R2A_2, . . . , R2A_4, the seven step resistors R2B_1, R2B_2, . . . , R2B_7, and the 11 selection transistors NA1, NA2, . . . , NA4 and NB1, NB2, . . . , NB7. Here, a number of the unit resistors and the step resistors may vary.

In an embodiment of the present invention, the resistor unit 10 of the voltage regulator according to an embodiment of the present invention adjusts a resistance value using relatively large resistors and small resistors obtained by dividing the resistance value of the large resistors, thereby obtaining the same voltage division effect using a smaller number of elements.

Figure 4:
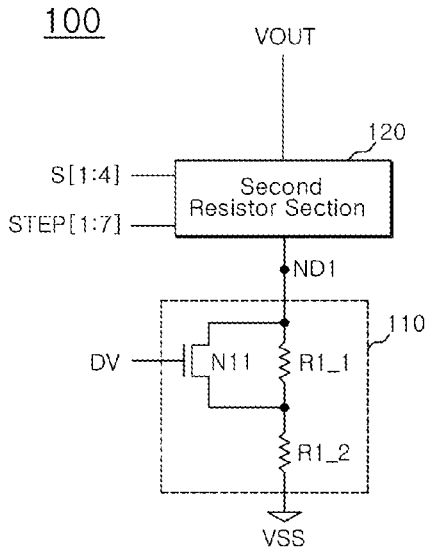
FIG. 4 is a circuit diagram of a resistor unit according to an embodiment of the present invention.

FIG. 4 is a circuit diagram of a resistor unit 100 according to an embodiment of the present invention.

The resistor unit 100 includes a first resistor section 110 and a second resistor section 120.

The first resistor section 110 includes a plurality of sub-resistors R1_1 and R1_2 as a first resistor. In an embodiment of the present invention, the first resistor section 110 includes a first sub-resistor R1_1 and a second sub-resistor R1_2 between a first node ND1 and a ground voltage VSS. Here, a connection of the first sub-resistor R1_1 may be controlled according to a division signal DV.

The second resistor section 120 may include a plurality of second resistors, control the number of the second resistors to be connected, and change the resistance value of the resistors.

In detail, the second resistor section 120 may include a plurality of resistors, having the same resistance value, between the output voltage VOUT and the first node ND1, or may include a plurality of unit resistors, e.g., four unit resistors R2A_1, R2A_2, . . . , R2A_4 and a plurality of step resistors, e.g., seven step resistors R2B_1, R2B_2, . . . , R2B_7. In an embodiment of the present invention, the number of the unit resistors R2A_1, R2A_2, . . . , R2A_n to be connected is adjusted in response to unit resistor selection signals S[1:4], and the number of the step resistors R2B_1, R2B_2, . . . , R2B_m to be connected is adjusted in response to step resistor selection signals S[1:7].

In an embodiment of the present invention, only the resistance value of the second resistor R2 can be adjusted in order to adjust the resistor ratio (R2/R1). However, in another embodiment of the present invention, the resistance value of the first resistor R1 can also be adjusted so as to effectively change the level of the output voltage VOUT using a relatively small number of elements.

In detail, the first resistor section 110 includes the first sub-resistor R1_1 and the second sub-resistor R1_2 coupled between the first node ND1 and the ground voltage VSS, and a division transistor N11 which controls the connection of the first sub-resistor R1_1 in response to the division signal DV.

When the resistance value of first sub-resistor R1_1 and the resistance value of the second sub-resistor R1_2 are set as the same value, the first resistor section 110 has a resistance value of R1 when receiving a deactivated division signal DV and a resistance value of R1/2 when receiving an activated division signal DV. Consequently, when the resistance value of the second resistor section 120 varies in the range of 40Ω to 79Ω, the division signal DV is activated, so that it is possible to increase the resistance ratio (R2/R1) to a value twice as large as the resistance ratio in the case of FIG. 2. As a consequence, by reducing the resistance value of R1 by half, the value of the output voltage may increase to a level corresponding to (1+2*(R2/R1))*VREF. In an embodiment of the present invention, the first resistor R1 is divided into two resistors. However, the present invention is not limited thereto. For example, the first resistor R1 may be divided into various numbers of sub-resistors.

The target level of the output voltage VOUT can be adjusted at an interval of 0.2*VREF in this case while the target level of the output voltage VOUT can be adjusted at an interval of 0.1*VREF in the case of the first resistor R1 is 10Ω. That is, the output voltage VOUT may increase effectively, but fine adjustment ability may deteriorate.

Figure 5:
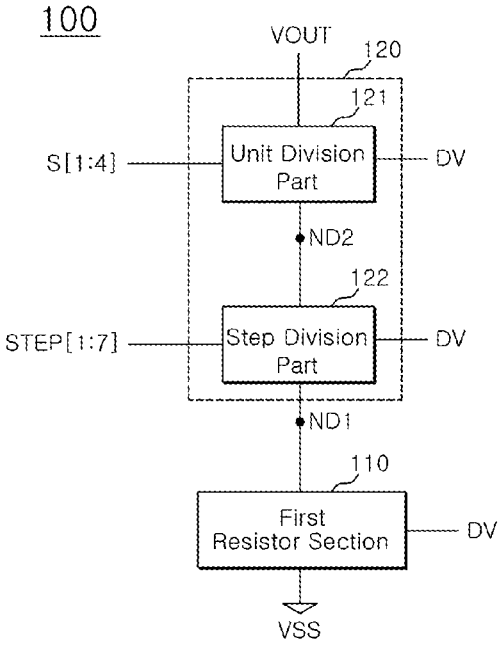
FIG. 5 is a circuit diagram of a resistor unit according to an embodiment of the present invention.

FIG. 5 is a circuit diagram of a resistor unit 100 according to an embodiment of the present invention.

The resistor unit 100 of FIG. 5 includes a first resistor section 110 and a second resistor section 120.

The first resistor section 110 includes the first sub-resistor R1_1 and the second sub-resistor R1_2 between the first node ND1 and the ground voltage VSS as described with reference to FIG. 4. Here, the connection of the first sub-resistor R1_1 may be controlled according to the division signal DV so as to effectively change the target level of an output voltage VOUT.

The second resistor section 120 includes a unit division part 121 and a step division part 122 coupled between the output voltage VOUT and the first node ND1.

The unit division part 121 changes a resistance value by the relatively high level in response to the unit resistor selection signals S[1:4], and reduces the changed resistor level, for example, by half in response to the division signal DV.

The step division part 122 changes a resistance value by the relatively low level in response to the step selection signals STEP[1:7], and reduces the changed resistor level, for example, by half in response to the division signal DV.

According to an embodiment of the present invention, for example, when the division signal DV is activated and the resistance value of the first resistor R1 is reduced by half, each of the unit division part 121 and the step division part 122 reduces the changed resistor level by half, thereby adjusting the output voltage VOUT by the unit the same as that when the division signal DV is deactivated.

Figure 6:
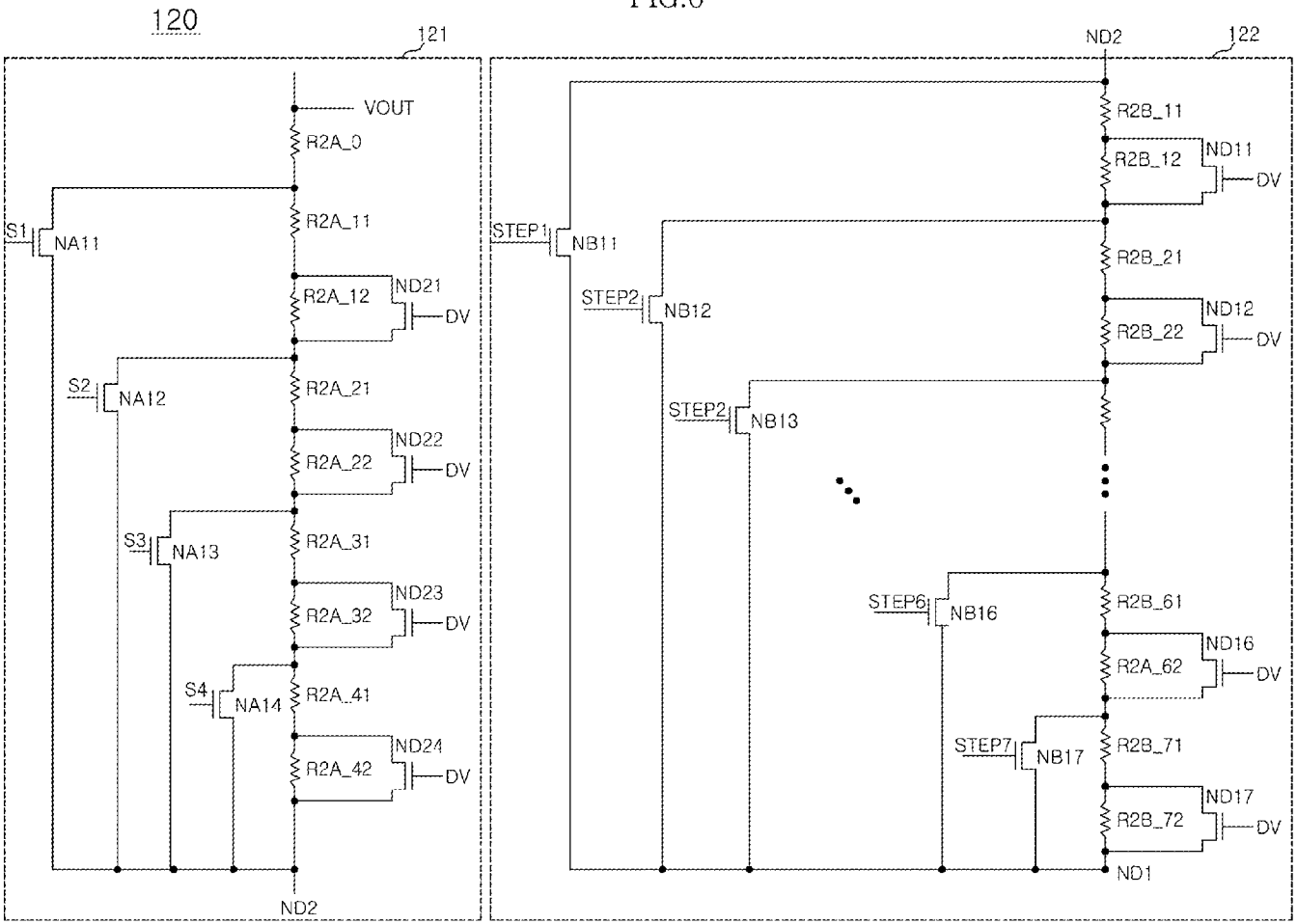
FIG. 6 is a detailed circuit diagram of a second resistor unit of FIG. 5.

FIG. 6 is a detailed circuit diagram of the second resistor unit 120 of FIG. 5 according to an embodiment of the present invention.

The second resistor section 120 includes the unit division part 121 coupled between the output voltage VOUT and a second node ND2 and the step division part 122 coupled between the second node ND2 and the first node ND1.

The unit division part 121 includes a reference resistor R2A_0, a plurality of unit resistors R2A_1 (e.g., R2A_11 and R2A_12), R2A_2 (e.g., R2A_21 and R2A_22), R2A_3 (e.g., R2A_31 and R2A_32), R2A_4 (e.g., R2A_41 and R2A_42), and a plurality of unit selection transistors NA11, NA12, . . . , NA14 for controlling the connections of the plurality of unit resistors R2A_1, R2A_2, . . . , R2A_4 in response to the unit resistor selection signals S1, S2, . . . , S4. Here, the reference resistor R2A_0 and the plurality of unit resistors R2A_1, R2A_2, . . . , R2A_4 are serially coupled to one another. Furthermore, the unit division part 121 includes a plurality of division transistors ND21, ND22, . . . , ND24 for reducing each resistance value of the unit resistors R2A_1, R2A_2, . . . , R2A_4 by half in response to the division signal DV.

When a deactivated division signal DV is received, the unit division part 121 controls the connections of the unit resistors R2A_1, R2A_2, . . . , R2A_4 according to the unit resistor selection signals S1, S2, . . . , S4.

When an activated division signal DV is received, the unit division part 121 reduces the resistance value of each of the unit resistors R2A_1, R2A_2, . . . , R2A_4 by half to create divided unit resistors R2A_11, R2A_21, . . . , R2A_41, and controls the connections of the divided unit resistors R2A_11, R2A_21, . . . , R2A_41 according to the unit resistor selection signals S1, S2, . . . , S4.

The step division part 122 includes a plurality of step resistors R2B_1 (e.g., R2B_11 and R2B_12), R2B_2 (e.g., R2B_21 and R2B_22), . . . , R2B_7 (e.g., R2B_71 and R2B_72), and a plurality of step selection transistors NB11, NB12, . . . , NB17 for controlling the connections of the plurality of step resistors R2B_1, R2B_2, . . . , R2B_7 in response to the step resistor selection signals STEP1, STEP2, . . . , STEP7. Here, the plurality of step resistors R2B_1, R2B_2, . . . , R2B_7 are serially coupled to one another. Furthermore, the step division part 122 includes a plurality of division transistors ND11, ND12, . . . , ND17 for reducing each resistance value of the step resistors R2B_1, R2B_2, . . . , R2B_7 by half in response to the division signal DV.

When the deactivated division signal DV is received, the is step division part 122 controls the connections of the step resistors R2B_1, R2B_2, . . . , R2B_7 according to the step resistor selection signals STEP1, STEP2, . . . , STEP7.

When the activated division signal DV is received, the step division part 122 reduces the resistance value of each of the step resistors R2B_1, R2B_2, . . . , R2B_7 by half to create divided step resistors R2B_11, R2B_21, . . . , R2B_71, and controls the connections of the divided step resistors R2B_11, R2B_21, . . . , R2B_71 according to the step resistor selection signals STEP1, STEP2, . . . , STEP7.

For example, the reference resistor R2A_0 may be set to 40Ω, each unit resistor R2A_1, R2A_2, . . . , R2A_4 may be set to 8Ω, and each step resistor R2B_1, R2B_2, . . . , R2B_7 may be set to 1Ω. When the division signal DV is activated, the divided unit resistors R2A_11, R2A_21, . . . , R2A_41 are set to 4Ω and the divided step resistors R2B_11, R2B_21, . . . , R2B_71 are set to 0.5Ω.

If the first resistor R1 is set to 10Ω and the deactivated division signal DV is input, the first resistor section 110 has a resistance value of 10Ω, and the second resistor section 120 may vary from 40Ω to 79Ω at an interval of 1Ω. That is, the output voltage VOUT may vary from 5*VREF to 8.9*VREF at an interval of 0.1*VREF.

When the activated division signal DV is input, the first resistor section 110 has a resistance value of 5Ω, and the second resistor section 120 may vary from 40Ω to 59.5Ω at an interval of 0.5Ω. That is, the output voltage VOUT may vary from 9*VREF to 11.9*VREF at an interval of 0.1*VREF.

That is, the resistance level of the first resistor section 110 and a variable resistance level of the second resistor section 120 are reduced by half using the division signal DV, so that it is possible to finely adjust the level of the output voltage VOUT while effectively increasing the level of the output voltage VOUT.

While certain embodiments have been described above, it will be understood to those skilled in the art that the embodiments described are by way of example only. Accordingly, the voltage regulator described herein should not be limited based on the described embodiments. Rather, the voltage regulator described herein should only be limited in light of the claims that follow when taken in conjunction with the above description and accompanying drawings.

What is claimed is:

1. A voltage regulator comprising:

a voltage generation unit configured to compare a reference voltage level with a voltage level of a first node and generate an output voltage;

a first resistor section comprising a first sub-resistor and a second sub-resistor between the first node and a ground voltage node, wherein the first resistor section is configured to control a connection between the first sub-resistor and the second sub-resistor to change a resistance value of the first resistor section; and a second resistor section comprising a reference resistor, a plurality of unit resistors, and a plurality of step resistors, wherein the second resistor section is configured to control connections of the unit resistors and the step resistors to change a resistance value of the second resistor section, wherein the first resistor section and the second resistor section are serially coupled between an output terminal of the output voltage and the ground voltage.

2. The voltage regulator according to claim 1, wherein the second resistor section is configured to control the connections of the plurality of unit resistors according to a unit resistor selection signal, and control the connections of the plurality of step resistors according to a step resistor selection signal.

3. The voltage regulator according to claim 1, wherein the first resistor section is configured to control the connection of the first sub-resistor according to a division signal.

4. The voltage regulator according to claim 1, wherein each resistance value of the step resistors is smaller than each resistance of the unit resistors.

5. The voltage regulator according to claim 4, wherein each resistance value of the step resistors is obtained by dividing each resistance of the unit resistors.

6. A voltage regulator comprising:

a voltage generation unit configured to compare a reference voltage level with a voltage level of a first node and generate an output voltage;

a first resistor section comprising a first sub-resistor and a second sub-resistor between the first node and a ground voltage node, wherein the first resistor section is configured to control a connection of the first sub-resistor according to a division signal; and a second resistor section comprising a reference resistor and a plurality of second resistors between an output terminal of the output voltage and the first node, wherein the second resistor section is configured to control connections of the plurality of second resistors and to reduce a resistance value of each second resistor according to the division signal.

7. The voltage regulator according to claim 6, wherein the second resistor section is configured to reduce a resistance value of each second resistor by half according to the division signal.

8. The voltage regulator according to claim 6, wherein the plurality of second resistors comprise a plurality of unit resistors and a plurality of step resistors obtained by dividing a resistance value of the unit resistors.

9. The voltage regulator according to claim 8, wherein the second resistor section comprises a unit division part configured to control connections of the plurality of unit resistors according to a unit resistor selection signal.

10. The voltage regulator according to claim 8, wherein the second resistor section comprises a step division part configured to control connections of the plurality of step resistors according to a step resistor selection signal.

11. The voltage regulator according to claim 9, wherein the unit division part is configured to reduce a resistance value of each unit resistor by half according to the division signal.

12. The voltage regulator according to claim 10, wherein the step division part is configured to reduce a resistance value of each step resistor by half according to the division signal.

13. A voltage regulator comprising:

a voltage generation unit configured to compare a reference voltage level with a voltage level of a first node and output an output voltage at an output terminal thereof;

a first resistor section comprising a first sub-resistor and a second sub-resistor serially coupled between the first node and a ground voltage node, and a first transistor coupled to both ends of the first sub-resistor and receiving a division signal through a gate terminal thereof; and a second resistor section comprising a reference resistor and one or more unit resistors serially coupled between the output terminal and a second node, a plurality of step resistors serially coupled between the second node and the first node, one or more second transistors coupled to one end of each unit resistor and the second node to receive a unit resistor selection signal through gate terminals thereof, and a plurality of third transistors coupled to one end of each step resistor and the first node to receive a step resistor selection signal through gate terminals thereof.

14. The voltage regulator according to claim 13, wherein the step resistor has a value obtained by dividing a resistance value of the unit resistor by a plural number.

15. The voltage regulator according to claim 13, wherein each unit resistor is divided into a first divided unit resistor and a second divided unit resistor, and the second resistor section further comprises:

one or more fourth transistors coupled to both ends of the first divided unit resistor to receive the division signal through gate terminals thereof.

16. The voltage regulator according to claim 15, wherein each step resistor is divided into a first divided step resistor and a second divided step resistor, and the second resistor section further comprises:

a plurality of fifth transistors coupled to both ends of the first divided step resistor to receive the division signal through gate terminals thereof.

* * * * *